US006250186B1

(12) United States Patent
O'Berry

(10) Patent No.: US 6,250,186 B1
(45) **Date of Patent: *Jun. 26, 2001**

(54) APPARATUS AND METHOD FOR FASTENING WOODWORKING MATERIALS

(75) Inventor: Patrick Brian O'Berry, Lindenhurst, IL (US)

(73) Assignee: O'Berry Enterprises, Inc., Crystal Lake, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/542,588

(22) Filed: Apr. 4, 2000

Related U.S. Application Data

(63) Continuation of application No. 09/257,729, filed on Feb. 25, 1999, which is a continuation of application No. 09/059,722, filed on Feb. 13, 1998, which is a continuation of application No. 08/675,436, filed on Jun. 27, 1996, now abandoned.

(51) Int. Cl.[7] ..... B25B 23/08
(52) U.S. Cl. ..... 81/451; 81/488
(58) Field of Search ..... 81/451, 488

(56) References Cited

U.S. PATENT DOCUMENTS 5,371,992 * 12/1994 O'Berry ..... 81/451 X
5,372,466 * 12/1994 O'Berry ..... 81/451 X

* cited by examiner

*Primary Examiner*—James G. Smith
(74) *Attorney, Agent, or Firm*—Mathew R. P. Perrone, Jr.

(57) ABSTRACT

An alignment and depth control fixture is used in combination with a scored screw and a drviing bit in order to direct the scored screw to the proper point while the driving bit can stop driving the screw at the desired depth of the screw threads in the wood.

6 Claims, 3 Drawing Sheets

FIG. 7
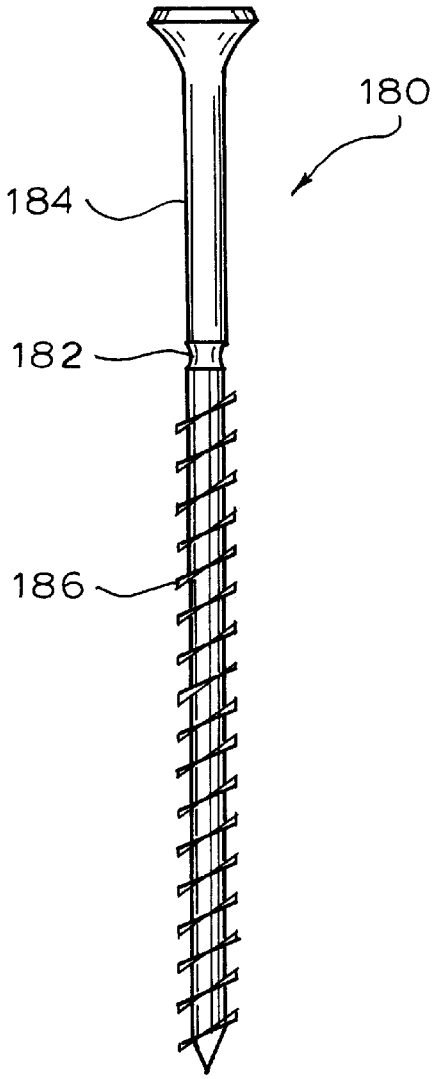
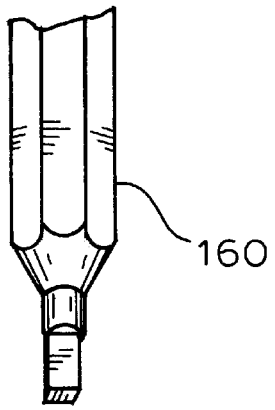
FIG. 8

APPARATUS AND METHOD FOR FASTENING WOODWORKING MATERIALS

CROSS-REFERENCE TO RELATED APPLICATION

This application is a continuation of U.S. patent application Ser. No. 09/257,729, filed Feb. 25, 1999; which, in turn, is a continuation of U.S. patent application Ser. No. 09/059,722, Filed Feb. 13, 1998; which, in turn, is a continuation of U.S. patent application Ser. No. 08/675,436, filed Jun. 7, 1996, now abandoned.

This invention relates to an apparatus and method for fastening woodworking materials, and more particularly to an apparatus and method for specifically driving screws to join at least two pieces of wood, with minimal repair work or finishing afterwards.

BACKGROUND OF THE INVENTION

In order to secure two or more pieces of woodworking material together, it is desirable to use a screw to join two pieces of wood together. The joined pieces of wood may be used to form a cabinet or other piece of furniture. Many steps are required to properly use a screw and have a final product with an aesthetically pleasing appearance.

By woodworking is meant any material used by a woodworker to build framing, molding, cabinets, and similar items. This woodworking material may be assembled with screws, and may made with or without doors.

By cabinet is meant any piece of wooden furniture, the pieces of which can be joined with at least one screw. Typical examples thereof include, but are not limited to, a bookcase, a china cabinet, an end table, a coffee table, lamp table, a credenza, a hutch, a curio cabinet, and similar items. This wooden furniture may be assembled with screws, and may be with or without doors.

The common practice in cabinet making, when it is desired to fasten two pieces of wood together, is to (1) drill a pilot hole, (2) countersink the hole to accommodate the head of the screw, (3) drive a screw into the pilot hole so that the head of screw is below the surface of the wood, and (4) then cover the hole with a dowel or wood filler. The hole to be filled is typically about six millimeters to seven millimeters in diameter.

The size of the aperture where the screw is used in cabinet making creates a major problem, due to the size of the head of the screw. It is both very difficult and time-consuming to fill in the aperture for the head of screw. It also requires great skill to provide a smooth skin cabinet finish. The size of problem increases in direct proportion to the size of the hole. In other words, the size of the hole is directly proportional to the difficulty of providing a pleasing appearance for the cabinet.

If a dowel is used to cover and fill the hole, the dowel is first glued and then placed in the aperture. The glue must then be allowed to dry. Then the portion of the dowel protruding from the hole must be cut off, usually by using a flush cutting saw. The cut surface of the dowel is then sanded smooth before a finish is applied.

The use of filler putty is more desirable, than the dowel. As the size of the aperture increases, the use of putty requires a geometrical increase in difficulty, time and skill. As putty dries, a concave dimple is formed. The depth of the dimple increase with the size of the aperture. The dimple has an adverse effect on the overall appearances of the wood, and additional putty may be required. Unless great skill is used, the putty and the resulting dimple can cause an unsightly blemish on the cabinet.

With this appearance, the attractiveness of the material and suitability of the material for decorative purposes is relatively decreased. It is desired to achieve this outstanding holding power of a screw without having to patch or conceal a large aperture.

It is furthermore difficult to place the screw in a proper hole with the proper guidance. The driving of the screw into the pilot hole requires great skill on the part of the woodworker. Use of that skill requires the woodworker's time. If a device can be developed to reduce the woodworker's time, while maintaining the excellent appearance of the material as used in a cabinet or other piece of furniture, a great advantage can be obtained.

SUMMARY OF THE INVENTION

Among the many objectives of this invention is the provision of an apparatus using a scored screw capable of joining two or more pieces of woodworking material.

A further objective of this invention is to provide an alignment fixture for inserting a screw into woodworking material.

A still further objective of this invention is to provide an accurate method for driving a screw into woodworking material.

Yet a further objective of this invention is to provide an accurate method of driving a screw into a cabinet.

Also an objective of this invention is to provide a method of restoring a decorative appearance to a screw aperture in woodworking material.

Another objective of this invention is to provide a simplified method of joining pieces of wood using a scored screw.

Yet another objective of this invention is to provide an accurate alignment and depth control fixture for driving a screw into a cabinet.

Still another objective of this invention is to provide a method for driving a screw an appropriate distance into a material efficiently.

A further objective of this invention is to provide a scored screw capable being driven into at least two pieces of wood accurately, with a proper breaking point for the screw.

These and other objectives of the invention (which other objectives become clear by consideration of the specification, claims and drawings as a whole) are met by providing at least one scored screw to be driven into at least two pieces of wood with a specialized driving bit and an alignment and depth control fixture to provide a proper position for the screw. The alignment and depth control fixture can be used to direct the scored screw to the proper point while the driving bit can stop driving the screw at the desired position in wood. The alignment and depth control fixture includes a device which applies torque or force to the screw, and breaks the screw at the prescored position.

BRIEF DESCRIPTION OF THE DRAWINGS

FIG. 7 depicts the scored screw 180.

FIG. 8 is a bit 160 which may be used to drive the scored screw 180.

Throughout the figures of the drawings, where the same part appears in more than one figure of the drawings, the same number is applied thereto.

DESCRIPTION OF THE PREFERRED EMBODIMENTS

Figure 1:
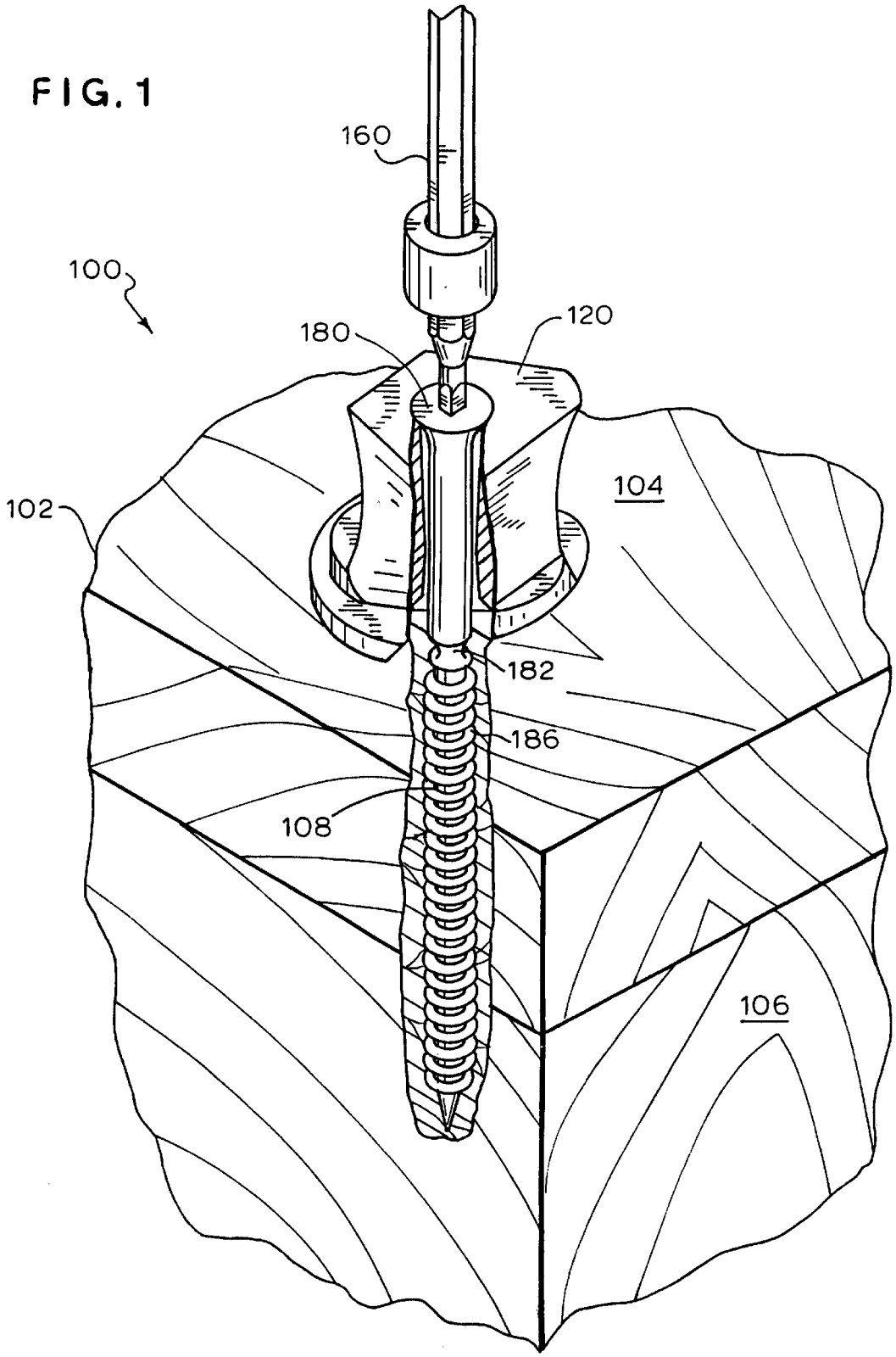
FIG. 1 depicts a top perspective view of a wood working device 100 including an alignment and depth control fixture 120 with a driving bit 160 and scored screw 180 for use in assembling a cabinet 102.

Woodworking materials or pieces of woodworking material are assembled by using a scored screw in combination with special driving bit and an alignment and depth control fixture. The alignment and depth control fixture can be used to direct the scored screw to the proper point into a small pilot hole or aperture. The driving bit is used to drive the scored screw to the desired position. An especially preferred desired position provides that the threads of the screw are in contact with at least two pieces of wood. The two pieces of wood have at least one point of mutual contact.

The alignment and depth control fixture has a tapered relieved area near its top surface within the aperture, which stops the scored screw at a desired position. The tapered relieved area also applies torque or force to the screw, thereby breaking the screw to separate the head and shaft at the prescored position.

It is possible to fasten the two pieces of wood together by drilling a pilot hole or aperture, using the specifically designed alignment and depth control fixture and driving the scored screw therethrough into the pilot hole. The fixture is designed so that when the head of the screw contacts the fixture with force the head and shank of the screw fracture. The head of the screw is then removed.

This pilot aperture may receive the scored screw to guide The resulting hole is up to about three millimeters in diameter and is easily filled with a wood filler, after the head of the screw separates from the shaft. This hole is less than half as big as the hole produced by the other method, which includes a recess for the head of a screw.

The alignment and depth control fixture, used in this method, is designed so that the screw can be driven to an exact depth each time it is used. This fixture insures that the threaded portion of shaft of the screw can be up to three millimeters below the wood surface, while the screw head is exposed for separation. The fixture is generally cylindrical.

A screw receiving aperture is preferably located on the axis of the cylinder. The screw receiving aperture has a sufficient diameter to allow the thread of the screw to pass through the top of the fixture. However, when a head of the screw contacts the fixture, the head is too large to pass therethrough, thus causing the head and shank of the screw to snap off and separate from the threads of a screw, leaving the threads joining two pieces of wood, and below the surface thereof.

The alignment and depth control fixture is used to guide the screw in straight, control the depth to which the screw is driven, provide a mechanical force that snaps the screw while creating a momentary force causing the two pieces of wood to be secured, and provide a safe method to guide the screw into the hold. The fixture may preferably have a gripping surface on the side of the cylinder to provide a secure grip and to keep the users hand and fingers from danger.

This method uses the scored screw described in U.S. Pat. No. 5,372,466 and U.S. Pat. No. 5,371,992. For this application the screws can be supplied in lengths used in cabinet making or other woodworking methods, but the design and use of the screw to allow the screw to be snapped at the score can result in the threads holding the two pieces of wood.

The advantages of this method are: improved manufacturing safety; one less manufacturing step; a smaller aperture or hole in a piece of wooden furniture, that is significantly easier to cover or otherwise conceal; and the joining strength two pieces of wood with the mechanical strength of a screw.

Referring now to FIG. 1, furniture making device 100 includes an alignment and depth control fixture 120 with a driving bit 160 and scored screw 180 for use in assembling woodworking materials such as cabinet 102. As the scored screw 180 reaches a certain point on alignment and depth control fixture 120, sufficient force is exerted on scored screw 180 to fracture the screw 180 at the score 182, thereby leaving the screw threads 186 holding a first piece of wood 104 and a second piece of wood 106 to form part, for example, of cabinet 102.

With regard to FIG. 2, FIG. 3, FIG. 4, FIG. 5 and FIG. 6; the depth control fixture 120 for use in woodworking is clearly depicted. The structure thereof shows its usefulness. The alignment and depth control fixture 120 can be used to direct the scored screw 180 to the proper point into a small pilot hole or aperture 108 in cabinet 102.

The alignment and depth control fixture 120 has a generally cylindrical shape, formed from any suitable rigid. material. On the cylindrical axis 122, is a fixture aperture 124 for receiving screw 180. Fixture aperture 124 has a large diameter area 126 and a small diameter area 128. Screw 180 may pass through large diameter area 126 into small diameter area 128 and then into cabinet 102.

A cylindrical height 130 for the alignment and depth control fixture 120 is sufficient to receive screw 180. The juncture 132 of large diameter area 126 and small diameter area 128 provide a step 134 therebetween. Screw 180 may pass through large diameter area 126 into small diameter area 128.

The alignment and depth control fixture 120 is used to guide the screw 180 into the wood straight, control the depth the screw 180 is driven to, provide a mechanical force that snaps the screw 180 while creating a momentary force causing the two pieces of wood for cabinet 102 to be secured, and provide a safe method to guide the screw 180 into the pilot aperture 108.

The alignment and depth control fixture 120 may optionally have gripping aids thereon in order to provide a secure grip and to keep the users hand and fingers from danger. Preferably however, the alignment and depth control fixture 120 has in the outer cylinder wall 140 a first notch 142 and a second notch 144 diametrically opposed thereto. First notch 142 and a second notch 144 can receive a thumb and finger of one hand and combine with the driving bit 160, to break screw 180 at score 182.

Figure 2:
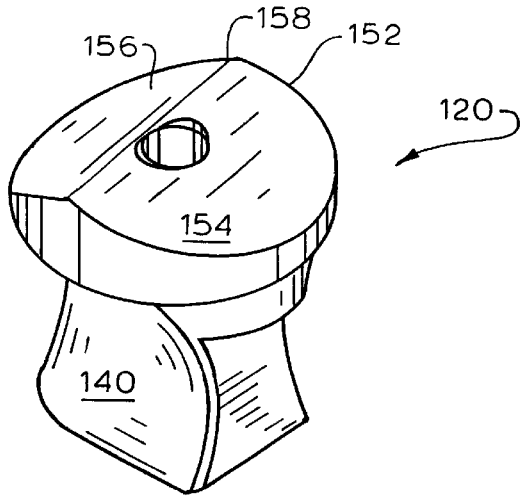
FIG. 2 depicts a bottom perspective view of the alignment and depth control fixture 120 for use in woodworking.
Figure 3:
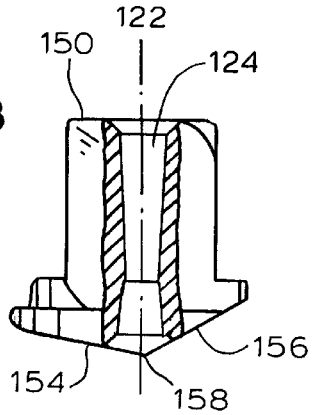
FIG. 3 depicts a side view in partial cross-section of the alignment and depth control fixture 120 shown in FIG. 1, but having a modification.
Figure 4:
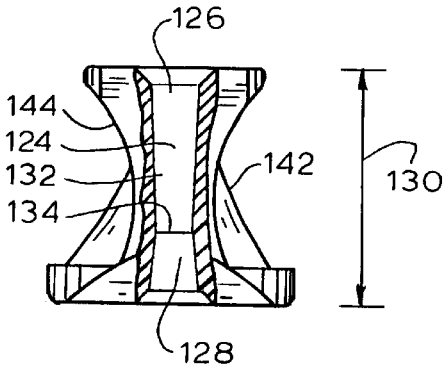
FIG. 4 depicts a side view in partial cross-section of the alignment and depth control fixture 120 shown in FIG. 3, but rotated about a vertical 90° axis.
Figure 5:
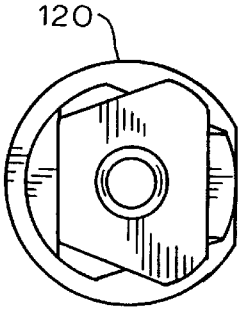
FIG. 5 depicts a top plan view of the alignment and depth control fixture 120.
Figure 6:
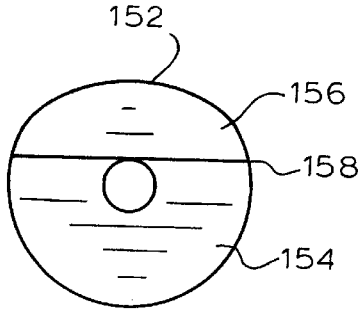
FIG. 6 depicts a bottom plan view of the alignment and depth control fixture 120.

Between FIG. 2 and FIG. 3, fixture aperture 124 has a slightly different structure. Adjacent to large diameter area 126 of fixture aperture 124 is a top surface defined as flat top 150, through which screw 180 is inserted. Adjacent to small diameter area 128 of fixture aperture 124 is angled base 152. Angled base 152 contacts cabinet 102. Angled base 152 is a bottom surface of the alignment and depth control fixture 120, and oppositely disposed from flat top 150.

Angled base 152 includes first angled portion 154 and second angled portion 156 adjacent to first angled portion 154. Second angled portion 156 abuts first angled portion 154 at edge 158. Edge 158 thus is the dividing line between second angled portion 156 and first angled portion 154.

Second angled portion 156 and first angled portion 154 are not parallel to flat top 150. First angled portion 154 forms an angle of up to about 40 degrees relative to flat top 150. More preferably, first angled portion 154 forms an angle of about 10 degrees to about 35 degrees relative to flat top 150. Most preferably, first angled portion 154 forms an angle of about 25 degrees to about 35 degrees relative to flat top 150.

Second angled portion 156 forms an angle relative to flat top 150 greater than the angle of first angled portion 154 and less than 75 degrees. More preferably, second angled portion 156 forms an angle relative to flat top 150 of about 45 degrees to about 70 degrees. Most preferably, second angled portion 156 forms an angle relative to flat top 150 of about 55 degrees to about 65 degrees.

In FIG. 2, edge 158 is substantially tangential to small diameter area 128. On the other hand, in FIG. 3, edge 158 substantially bisects small diameter area 128. Whether the alignment and depth control fixture 120 is that of FIG. 2 or FIG. 3 depends on the type of cabinet 102 being formed.

Adding FIG. 7 and FIG. 8 to the consideration, it can be seen how screw 180 passes through alignment and depth control fixture 120 when driven by typical bit 160. The shank 184 of screw 180 separates from threads 186 at score 182 when the shank 184 contacts step 134.

This separation or breaking of the screw 180 at the score 182 leaves the threaded portion 186 of the screw 180 holding two pieces of wood for cabinet 102 joined. The diameter of the screw pilot aperture 108 is a little smaller than the diameter of the shank 184. This makes the pilot aperture 108 much easier to conceal for aesthetic reasons.

Rocking the alignment and depth control fixture 120 between second angled portion 156 and first angled portion 154 breaks the screw 180 at the score 182. Threads 186 are left in contact with the cabinet 102 (FIG. 1), thereby forming an easily concealed joining mechanism.

This application—taken as a whole with the specification, claims, abstract, and drawings-provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A positioning fixture for positioning a scored screw to join at least a first piece of wood to a second piece of wood, the positioning fixture comprising:

(a) the positioning fixture serving as an alignment and depth control fixture to direct the scored screw to the proper point;

(b) the positioning fixture including a means to break the scored screw;

(c) the positioning fixture including a top surface for receiving the scored screw and a bottom surface for contacting the first piece of wood;

(d) the positioning fixture including a screw-receiving aperture;

(e) the top surface communicating with the bottom surface through the screw-receiving aperture;

(f) the screw-receiving aperture having a larger diameter adjacent to the top surface and a smaller diameter adjacent to the bottom surface;

(g) the bottom surface including a first angled portion and a second angled portion adjacent to the first angled portion; and (h) an edge dividing the first angled portion from the second angled portion.

2. The positioning fixture of claim 1 further comprising:

(a) the screw-receiving aperture being too small for a head of the screw to pass therethrough to thereby set a depth in the wood for the screw; and (b) the screw receiving aperture cooperating with the means to break the scored screw.

3. The positioning fixture of claim 2 further comprising:

(a) a step in the screw-receiving aperture; and (c) the step providing the breaking means for the screw.

4. The positioning fixture of claim 3 further comprising:

(a) the positioning fixture for the screw having a generally cylindrical shape and a cylindrical axis therefor;

(b) the screw receiving aperture being located on the cylindrical axis; and (c) the screw receiving aperture having a sufficient diameter to allow a thread of the screw to pass through the top surface of the positioning fixture and to prevent a head of the screw passing therethrough.

5. The positioning fixture of claim 4 further comprising:

(a) the generally cylindrical shape having at least a first indentation and a second indentation therein to permit gripping of the positioning fixture; and (b) the positioning fixture directing the scored screw to a proper point.

6. The positioning fixture of claim 5 further comprising:

(a) the positioning fixture being formed of a rigid material;

(b) the first indentation being substantially oppositely disposed from the second indentation; and (c) a side of the generally cylindrical shape including the first indentation and the second indentation.

* * * * *